United States Patent [19]

Kirkland

[11] 4,446,015

[45] May 1, 1984

[54] FIELD FLOW FRACTIONATION CHANNEL

[75] Inventor: Joseph J. Kirkland, Wilmington, Del.

[73] Assignee: E. I. Du Pont de Nemours and Company, Wilmington, Del.

[21] Appl. No.: 326,158

[22] Filed: Nov. 30, 1981

[51] Int. Cl.[3] ..... B03B 5/62

[52] U.S. Cl. ..... 209/155; 494/27; 494/43

[58] Field of Search ..... 209/1, 155, 208, 209, 209/444, 453; 233/1 A, 14 R, 14 A, 27, 45, 46, 1 E, 16, 21, 26, 28, 40 R

[56] References Cited

U.S. PATENT DOCUMENTS

| | | | |
|---|---|---|---|
| 3,465,956 | 9/1969 | Beard | 233/27 X |
| 3,519,201 | 7/1970 | Eisel et al. | 233/21 |
| 4,094,461 | 6/1978 | Kellogg et al. | 233/40 |
| 4,283,276 | 8/1981 | Grant | 209/155 |
| 4,353,795 | 10/1982 | Romanauskas | 209/155 |
| 4,357,235 | 11/1982 | Dilks | 209/155 |

FOREIGN PATENT DOCUMENTS

| | | | |
|---|---|---|---|
| 2843118 | 4/1979 | Fed. Rep. of Germany | 233/1 R |

*Primary Examiner*—Ralph J. Hill

[57] ABSTRACT

A free floating plastic channel for sedimentation field flow fractionation is suspended in a centrifuge rotor filled with a compensating liquid. The channel is constructed of a plastic central hub assembly fitted with a plastic outer ring preferably having a lower density than the hub. The outer ring contains a shallow channel on its radially inner surface and is interference-fitted to the inner ring to insure a liquid tight seal at zero force field. With the liquid totally surrounding the hub-outer ring assembly, stresses on the plastic parts are essentially equalized even under high force fields and leakage from the channel at the hub-ring interface is greatly reduced.

2 Claims, 6 Drawing Figures

COMPUTER

FIELD FLOW FRACTIONATION CHANNEL

CROSS-REFERENCE TO RELATED APPLICATIONS

This application is related to inventions described in U.S. Pat. No. 4,283,276, issued Aug. 11, 1981 to John Wallace Grant, copending application Ser. No. 249,963, filed Apr. 1, 1981 and entitled "Field Flow Fractionation Channel" by William Andrew Romanauskas, copending application Ser. No. 326,156, filed Nov. 30, 1981 and entitled "Apparatus and Method for Sedimentation Field Flow Fractionation"by Kirkland et al. copending application Ser. No. 326,157, filed Nov. 30, 1981 and entitled "Sedimentation Field Flow Fractionation Channel" by J. J. Kirkland and copending application Ser. No. 352,077 filed Feb. 25, 1982 and entitled "Method and Apparatus for Improving Sedimentation Field Flow Fractionation Channels" by William Andrew Romanauskas.

BACKGROUND OF THE INVENTION

Sedimentation field flow fractionation is a versatile technique for the high resolution separation of a wide variety of particulates suspended in a fluid medium. The particulates include macromolecules in the $10^5$ to the $10^{13}$ molecular weight (0.001 to 1$\mu$m) range, colloids, particles, micelles, organelles and the like. The technique is more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

In sedimentation field flow fractionation (SFFF), use is made of a centrifuge. A thin annular belt-like channel is made to rotate about the axis of the annulus. The resultant centrifugal force causes sample components of higher density than the mobile phase to sediment toward the outer wall of the channel. For equal particle density, because of their higher diffusion rate, smaller particulates will accumulate into a thicker layer against the outer wall than will larger particulates. On the average, therefore, larger particulates are forced closer to the outer wall.

If now the mobile phase or solvent is fed continuously from one end of the channel, it carries the sample components through the channel for later detection at the outlet of the channel. Because of the shape of the laminar velocity profile within the channel and the placement of particulates in that profile, solvent flow causes smaller particulates to elute first, followed by elution of components in the order of ascending particulate mass.

There are many criteria that a channel should meet in order to provide accurate particulate characterization data in short time periods. One such criteria is that the separating channel must be relatively thin. Unfortunately, this creates many problems in that the walls of the channel also should have a microscopically smooth finish to prevent the particles from sticking to the walls or being trapped in wall crevices. To provide such a microfinish, as well as to permit cleaning of the channel walls, it is desirable to have access to the interior of the channel. This is most easily achieved, as described in the Grant patent or the Romanauskas application by the use of mating inner and outer rings with a rectangular groove in the face of one or the other rings defining the channel.

A problem encountered when the channel is formed by mating rings is that of leakage. Leakage is caused by the centrifugally induced pressure inside the channel tending to force the fluid medium out between the contacting sealing surfaces of the rings. Leaks may occur because the high force field needed for the separation of the smaller particulates and lower molecular weight solutes distorts the channel itself and tends to cause leakage where none would normally exist. Another problem encountered in SFFF is the inability to easily provide a variety of channels having different widths, thicknesses, lengths, aspect ratios, and the like while maintaining the thickness dimension of the channel absolutely constant during centrifugal operation.

SUMMARY OF THE INVENTION

This invention finds use in an apparatus for separating particulates suspended in a fluid medium according to their effective masses. The apparatus has an annular channel with an annulus axis, means for rotating the channel about the axis, means for passing the fluid medium circumferentially through the channel, and means for introducing the particulates into the medium for passage through the channel, the channel being defined by the interface between an outer ring and an inner ring or hub mating with the outer ring. The hub and ring are mounted in a rotor bowl filled with a compensating liquid that surrounds both the hub and outer ring during centrifugal operation. This totally immerses the hub and ring and reduces centrifugally imposed stresses on them and leakage of the fluid medium from the channel through the hub and ring interface. In accordance with this invention the channel is defined by a groove in the mating surface of the outer ring. This construction has many advantages. Different outer rings can be constructed each having a different sized or configured groove. Thus simply by changing outer rings, different channels are obtained and the rings can be easily cleaned.

The hub and ring are formed of plastics and the ratio of the effective density to the tensile modulus of the outer ring is less than the ratio of the effective density to the tensile modulus of the hub. The effective density is the density of the channel material minus the density of the bowl fillin liquid. This insures good contact between the hub and ring since the expansion of a disclike or ringlike structure subjected to centrifugal force is related to the ratio of the structure's effective density $\phi$ to its tensile modulus E. Preferably, the density of the outer ring is less than the specific density of the hub to insure that the compensating liquid does not separate these two units. A smaller effective specific density to tensile modulus ratio of the outer ring aids in causing the inner ring or hub to expand during centrifugation into sufficient contact with the outer ring to maintain a good seal when the centrifugal force field is imposed. Under static conditions this seal may be maintained by forming the hub and ring to have an interference fit.

BRIEF DESCRIPTION OF THE DRAWINGS

Further advantages and features of this invention will become apparent from the following description wherein.

DETAILED DESCRIPTION OF THE PREFERRED EMBODIMENT

Figures 1, 5:
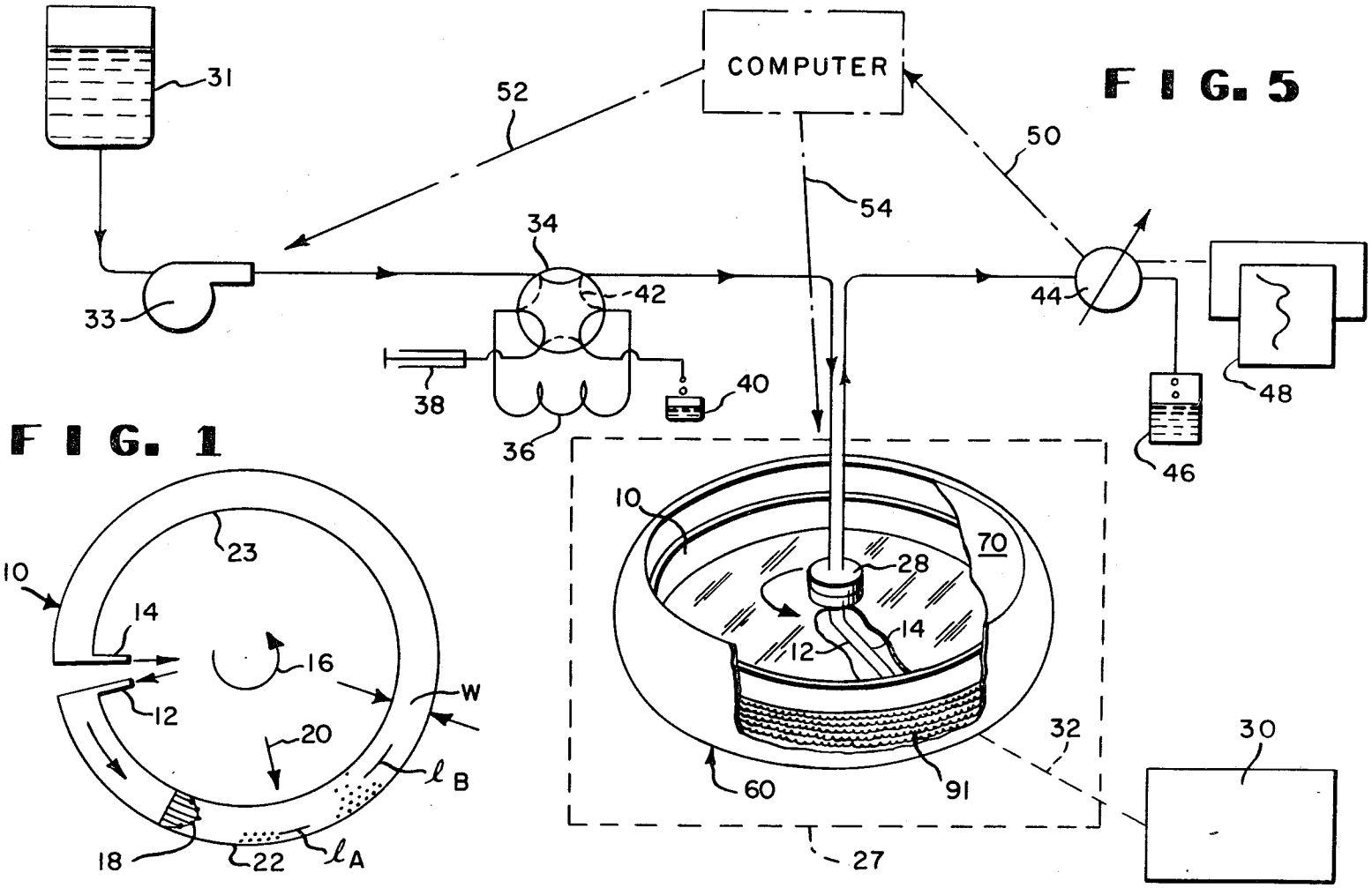
FIG. 1 is a simplified schematic representation of a sedimentation field flow fractionation technique.
FIG. 5 is a partially schematic, partially pictorial representation of an SFFF system using apparatus constructed in accordance with this invention.

The principles of operation of a typical SFFF apparatus with which this invention finds use may perhaps be more easily understood with reference to FIG. 1. In FIG. 1 there may be seen an annular ringlike (even ribbonlike) channel 10 having a relatively small thickness (in the radial dimension) designated W. The channel has an inlet 12 in which the mobile phase or liquid is introduced together with, at some point in time, a small sample containing a particulate to be fractionated, and an outlet 14. The annular channel is spun in either direction. For purposes of illustration the channel is illustrated as being rotated in a counterclockwise direction denoted by the arrow 16. Typically, the thickness of these channels may be in the order of magnitude of 0.025 cm. Actually, the smaller the channel thickness, the greater rate at which separations can be achieved and the greater the resolution of the separations. Alternatively, thicker channels extend the separation range to smaller particles but at the expense of broader peaks.

The channel 10 is defined by an outer surface or wall 22 and an inner surface or wall 23. If now a radial centrifugal force field F, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field F and by the normal opposing diffusion forces due to Brownian motion. Because the particulates are in constant motion at any given moment, any given particulate may be found at any distance from the wall with varying degree of probability. Over a long period of time compared to the diffusion time, every particulate in the cloud will have been at different heights from the wall many times. However, the average height from the wall of all of the individual particulates of a given mass over that time period will be the same. Thus, the average height of the particulates from the wall will depend on the mass of the particulates, larger particulates having an average height $1_A$ (FIG. 1) that is less than that of smaller particulates $1_B$ (FIG. 1).

If one now causes the fluid in the channel to flow at a uniform speed, there is established a parabolic profile of flow 18. In this laminar flow situation, the closer a liquid layer is to the wall, the slower it flows. During the interaction of the compressed cloud of particulates with the flowing fluid, the sufficiently large particulates will interact with layers of fluid whose average speed will be less than the average for the entire liquid flow in the channel. These particulates then can be said to be retained or retarded by the field or to show a delayed elution from the channel. This mechanism is described by Berg and Purcell in their article entitled "A Method For Separating According to Mass a Mixture of Macromolecules or Small Particles Suspended in a Fluid, I-Theory," by Howard C. Berg and Edward M. Purcell, Proceedings of the National Academy of Sciences, Vol. 58, No. 3, pages 862–869, September 1967.

Figure 2:
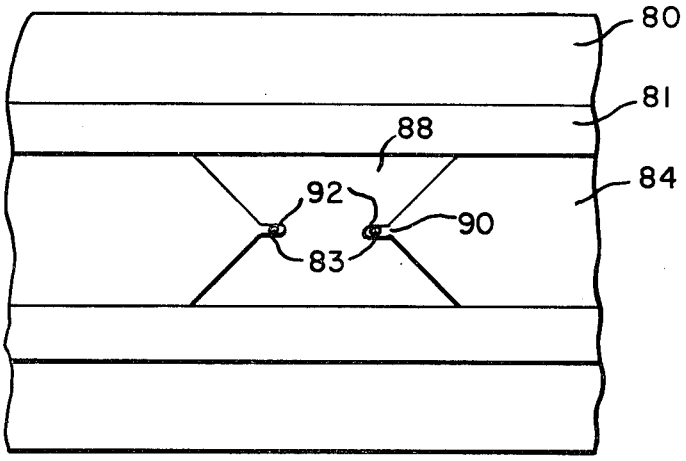
FIG. 2 is a cross sectional elevation view of a SFFF channel constructed in accordance with one embodiment of this invention and positioned in a zonal rotor.

A channel housing for SFFF is constructed as described in the Dilks et al. patent application that is substantially leak-free, provides reduced stresses on the parts forming the channel and may be readily changed to permit the use of different sizes and types of channels. The housing is immersed or floated in a compensating liquid. This is accomplished, as may best be seen in FIGS. 2, 4 and 5, by housing the channel 10 in a bowl-type rotor or an otherwise conventional zonal rotor 60 adapted to rotate about an axis 62 and housed within a conventional rotor containment housing in a centrifuge (depicted by the dashed lines 27 of FIG. 5). The rotor has a cover 70 that fits on the bowl 60.

A rotating seal 28 (FIG. 5), secured in the usual manner permits th passage of fluids to and from the channel 10. The rotating seal 28 may be of conventional design, such as those typically used with zonal rotors to couple fluids to and from the rotor, that is capable of high speed, leak-free operation under sometimes significant vibration conditions. Preferably, the rotating seal 28 is one such as that described by Charles H. Dilks, Jr. in his application Ser. No. 125,854, filed Feb. 29, 1980 and entitled "Drive for Rotating Seal" in which a flexible shaft 72, mounted to the cover 70 of the rotor 60, provides the drive for the rotating seal. This flexible shaft 72 aids in decoupling vibrations from the rotor body to the rotating seal and provides a more trouble-free seal. Fluids passing through the seal are conducted by suitable flexible tubing, such as TEFLON polyfluoro plastic tubing 74, to the channel.

The zonal rotor 60 may be that sold by E. I. du Pont de Nemours and Company designated the TZ-28 Zonal Rotor. The zonal rotor 60' depicted in FIG. 4 has a configuration of the TZ-28 Zonal Rotor. Alternatively, the rotor may be a CF-32Ti sold by Beckman Instruments. This latter rotor is depicted as 60 in FIG. 2. Actually any type rotor capable of housing the channel housing, i.e., the hub and outer ring, and holding a liquid to totally immerse or "float" the channel housing, may be used.

According to this invention, the housing for channel 10 is formed by an inner ring or hub 76 and a mating outer ring 80 positioned in the bowl of the rotor 60. The hub 76 and outer ring 80 are formed to have a diametrical interference fit of about 0.03 centimeters (cm) so that the outer ring 80 is in constant compressive contact with the hub 76 under static conditions. The inner or mating surface 82 of the outer ring 80 has a channel or groove 84 formed therein leaving lands 81 on either side of the groove 84. The outside portions 85 of the inner surface 82 are removed to limit the axial width of the lands 81 and thereby enhance their ability to seal the channel when they contact the peripheral surface of the hub 76. This groove 84 may be formed to have different thicknesses, different widths, different lengths, different aspect ratios (width to thickness ratio) and, if desired, may be formed in a spiral.

The beginning and end of each channel and the manner in which fluids are fed to and withdrawn therefrom are preferably those described in U.S. Pat. No. 4,284,498 issued to Grant et al. On Aug. 18, 1981, the disclosures of which is incorporated herein by reference. Fluids are fed from the rotating seal 28 (FIG. 5) through tubing 74 (12, 14 in FIG. 5) to circumferentially spaced radial bores 83 in the hub 76 to the beginning and end of the channel 10. The beginning and end of the channel groove 84 is defined by a plastic shim 88 having a close fit with the channel axial width. The shim 88 has inverted V-shaped ends with the apex 90 of the V slotted as at 92 to encompass the respective bores 83. The shim 88 may be formed of a Noryl polyphenylene oxide plastic and be cemented into position. It may be slightly thicker than the depth of the channel groove 84. Thus, when it is compressed by the smooth outer peripheral surface of the hub 76, it seals and defines the beginning and end of the channel 10.

The interior of the bowl-type rotor 60 preferably is filled with a liquid of approximately the same density as the fluid medium that is forced to flow through the channel. Further, the outer ring 80 is formed to have a diameter slightly less than the interior diameter of the rotor bowl 60 so that it does not contact the inside of the bowl even during centrifugation. On the other hand, the hub 76 is configured so that it fits concentrically over the interior hub 94 of the rotor 60, so as to be mounted securely thereon, and to have a nib 96 that engages a receptacle 98 in the cover 70 to center the channel housing 76, 80. The mid-portion 100 of the hub 76 may be in the form of an annulus having a reduced thickness to facilitate the radially outward expansion of the hub 76 during centrifugation to facilitate its following the outer ring expansion.

Liquid, typically water or other aqueous based liquid, thus surrounds essentially all of the channel housing 76, 80. Under these conditions, when the rotor 60 is rotated, centrifugal force causes the liquid pressure exerted by the liquid in the rotor bowl 60, external to the channel, and that exerted internally by the fluid medium within the channel to be substantially equal. Hence, leakage is essentially eliminated at the interface 81 between the hub and outer ring and stress on the channel assembly is greatly reduced permitting the use of plastics.

The hub 76 and outer ring 80 preferably are each constructed of a suitable engineering plastic selected such that the effective density $\phi$ to tensile modulus E ratio of the outer ring is somewhat less than the effective density $\phi$ to tensile modulus E ratio of the hub. The effective density is the density of the channel material minus the density of the bowl fillin liquid. This is done so that the hub can expand outwardly to a greater extent than the outer ring to maintain a good contact, during centrifugation, with the outer ring and thereby maintain the integrity of the channel. In addition, if the density of the outer ring is less than that of the hub, the density of the compensating liquid can be selected to be different from the density of the fluid medium and to lie between the densities of the hub and outer ring. When the compensating liquid density exceeds that of the outer ring, the outer ring will literally float under a force field and be forced to have closer contract with the inner ring. It should be noted that if the density of the outer ring is greater than that of the inner ring, then the use is limited to compensation liquid densities less than that of the hub or else the hub can separate from the outer ring under some operating conditions. With the effective density $\phi$ to tensile modulus E. ratio of the outer ring less than the effective density $\phi$ to tensile modulus E ratio of the hub, the hub will expand under centrifugal force at a faster rate than the outer ring and maintain good contact therebetween during centrifugal operation. Preferably, the density of the compensating liquid within the rotor is selected to be approximately equal to the density of the outer ring such that there is little expansion or contraction of the outer ring due to the effects of the liquid.

In one channel assembly that was built and successfully operated, an outer ring was constructed of a Noryl polyphenylene oxide engineering plastic manufactured by General Electric Co. having a density of 1.06 g/cm$^3$ and a tensile modulus of $25.0\times10^6$ g/cm$^2$ whereas the hub was constructed of Delrin® polyacetal engineering plastic having a density of 1.42 g/cm$^3$ and a tensile modulus of $28.8\times10^6$ g/cm$^2$. The outer ring had an outside diameter of 17.475 cm to clear the inside bowl diameter of a Beckman model CF-32Ti rotor (with an inside diameter of 17.792 cm) and an axial width of 7.478 cm with a rectangular groove of 2.54 cm in axial width or span, and 0.0254 cm in radial depth to form the channel with lands 0.953 cm in axial width. The hub was 13.818 cm in diameter with the portion 100 being 2.54 cm in thickness. The overall axial height was 8.611 cm with a beveled nib 96 to fit in the Beckman bowl rotor. This rotor was successfully operated with centrifugal forces up to about 85,000 G.

With this construction, relatively low cost, high-precision SFFF channels can be constructed that are capable of accurate molecular weight or particle size analysis under a wide range of operating conditions. Because of the "floating" channel design, mechanical stress on the component parts is greatly reduced and the specified channel dimensions are maintained over a wide range of force fields even when plastics are used. There is little tendency for the channel to leak since there is little or no pressure difference between the liquids inside and outside the channel. Furthermore, simply by replacing the outer ring, channels of different thickness, width, length, and aspect ratios may be selected and used. With the groove formed in the outer ring, the hub is reusable and provides a slightly greater centrifugal force. Different outer rings thus can be substituted to provide different channels.

In alternative embodiments of the invention, the outside ring can be constructed of a metal although plastics are preferred because of the ease of manufacture and their lower cost. While many engineering plastics may be used for the construction of the channel assembly, the criteria for selecting the particular plastics used include that the surface of the plastic must be capable of being polished to a smoothness of 3 micrometers or less. The plastics must exhibit the necessary density to tensile modulus ratio such that this ratio for the inner ring is greater than that for the outer ring. It is desirable that both rings have a relatively high tensile modulus, i.e., in excess of $17.6\times10^6$ g/cm$^2$. The materials used should be chemically inert, have a high yield strength, and be biologically nontoxic.

Figure 3:
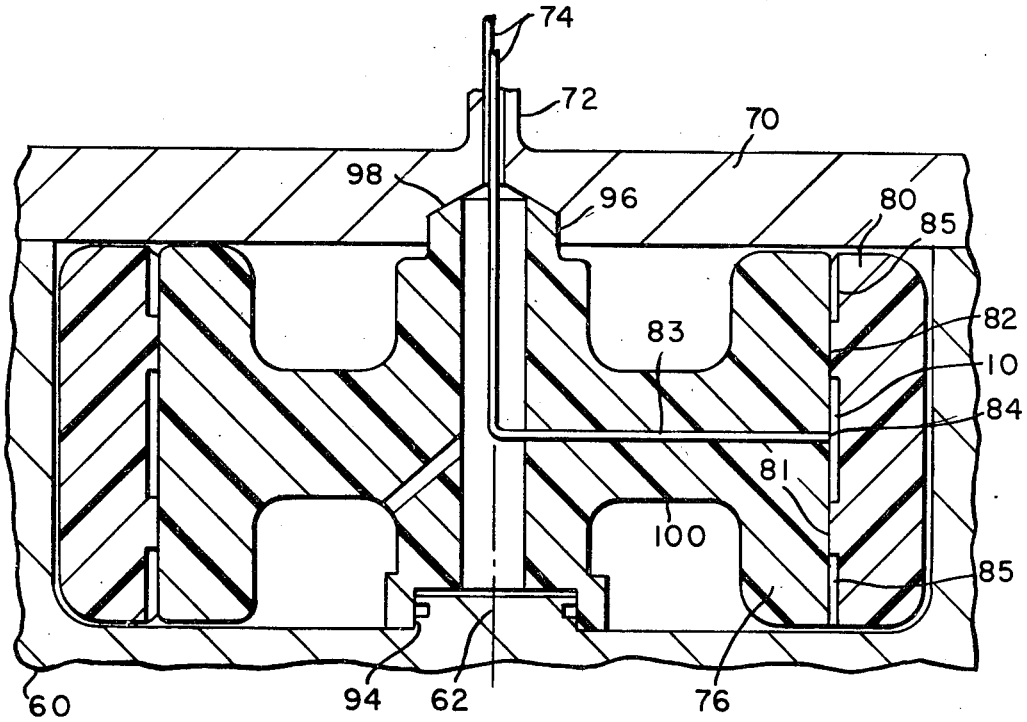
FIG. 3 is a fragmentary side elevation view of a portion of the channel of FIG. 2.
Figure 4:
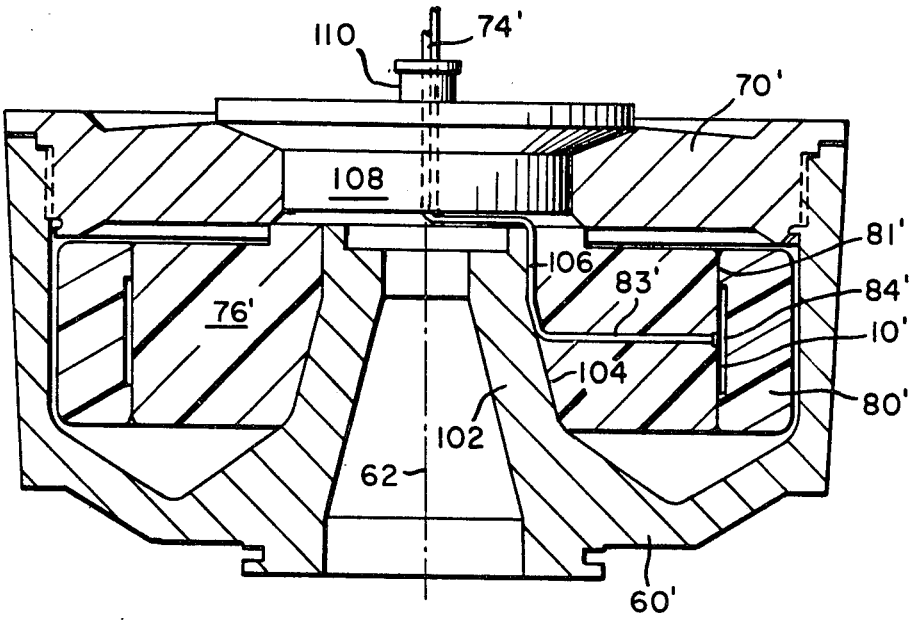
FIG. 4 is a cross sectional elevation view of an alternative SFFF channel positioned in a zonal rotor.

An alternative embodiment of the invention is illustrated in FIG. 4. In this figure, a commercially available Sorvall TZ-28 zonal rotor 60' having a different internal configuration is illustrated, i.e., the configuration is one whose annulus has a somewhat lesser radial dimension. The construction of this embodiment is substantially the same as that of FIGS. 2 and 3 with the exception of the mounting of the hub 76' on the rotor 60'. In this case, the bowl-type rotor 60' has a beveled mounting hub 102. Accordingly, the inner portion 104 of the hub 76' is beveled to accommodate the mounting hub 102. This permits the hub 76' to have a smaller annulus—hence the mid-portion of the hub 76' need not be reduced in axial thickness. To accommodate the fluid medium conduits 74', axial grooves 106 are formed in the inner beveled portion 104 of the hub 76' to communicate through axial bores 83' to the channel groove 84'. A plug 108 fits in the central orifice in the cover 70' and the flexible drive shaft 72 (FIG. 2) is attached thereto as by a fitting 110. Otherwise, the construction is the same as in FIGS. 2 and 3. The outer ring 80' has an annular groove 84' formed in the inner surface leaving lands 81' to contact the hub and seal the channel 10'.

Figure 6:
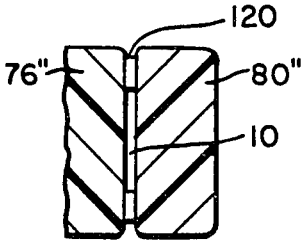
FIG. 6 is fragmentary, cross-sectional elevation view of an alternative embodiment of the channel assembly.

In an alternative embodiment illustrated in FIG. 6, a spacer 120 is sandwiched between the hub 76'' and outer ring 80'' to form the channel 10. The spacer may be metal, but preferably is a plastic the same as either the hub or outer ring and may be formed from a sheet with the mid-portion removed to define the channel. The thickness of the sheet of course determines the thickness of the channel and the ends of the channel are established by the mid-portions of the sheet that are not removed.

For the sake of a complete disclosure, the floating channel of this invention may be used in the system depicted in FIG. 5. The inlet fluid (or liquid) or mobile phase of the system is derived from suitable solvent reservoirs 31 which are coupled through a conventional pump 33 thence through a two-way, 6-port sampling valve 34 of conventional design through a rotating seal 28, also of conventional design, to the inlet tube 12 of the channel 10, and through the channel. The channel is depicted disgrammatically as floating or totally immersed, i.e., surrounded by a compensating liquid 91, in a rotor 60 having a cover 70 to contain the liquid.

Samples whose particulates are to be separated are introduced into the flowing fluid stream by the sampling valve 34 in which a sample loop 36 has either end connected to opposite ports of the valve 34 with a syringe 38 being coupled to an adjoining port. An exhaust receptacle 40 is coupled to the final port. When the sampling valve 34 is in the position illustrated by the solid lines, sample fluid may be introduced into the sample loop 36 with sample flowing through the sample loop to the exhaust receptacle 40. Fluid from the solvent reservoir 31 in the meantime flows directly through the sample valve 34. When the sample valve 34 is changed to a second position, depicted by the dashed lines 42, the ports move one position such that the fluid stream from the reservoir 31 now flows through the sample loop 36 before flowing to the rotating seal 28. Conversely the syringe 38 is coupled directly to the exhaust receptacle 40. Thus, the sample is carried by the fluid stream to the channel 10.

The outlet line 14 from the channel 10 is coupled back through the rotating seal 28 to a conventional detector 44 and thence to an exhaust or collector receptacle 46. The detector may be any of the conventional types, such as an ultraviolet absorption or a light scattering detector. In any event, the analog electrical output of this detector may be connected as desired to a suitable recorder 48 of known type and in addition may be connected as denoted by the dashed line 50 to a suitable computer for analyzing this data. At the same time this system may be automated, if desired, by allowing the computer to control the operation of the pump 33 and also the operation of the centrifuge 27. Such control is depicted by the dashed lines 52 and 54, respectively.

I claim:

1. In an apparatus for separating particulates suspended in a fluid medium according to their effective masses, said apparatus having an annular channel with an annulus axis, means for rotating said channel about said axis, means for passing said fluid medium circumferentially through said channel, and means for introducing said particulates into said medium for passage through said channel, said channel being defined by the interface between an outer ring and a hub mating with said outer ring, said hub and ring being mounted in a rotor adapted to contain a liquid that surrounds both the hub and ring during said rotation, the improvement wherein:

said channel is defined by a groove in the inner surface of said outer ring.

2. A channel assembly forming a channel for sedimentation field flow fractionation comprising:

a dislike hub having a smooth outer peripheral surface, a continuous outer ring having a radially inner surface, defining a circumferential groove, mating with said hub outer peripheral surface to define an annular channel at the interface between said surfaces, and radial bores in said hub communicating with said channel, both said hub and said ring being formed of a plastic.

* * * * *